US008950654B2

(12) United States Patent
Schultz

(10) Patent No.: US 8,950,654 B2
(45) Date of Patent: Feb. 10, 2015

(54) FOLDING CARTON WITH AUTO-ERECTING BOTTOM

(71) Applicant: Menasha Corporation, Neenah, WI (US)

(72) Inventor: Bradly Thomas Schultz, Greenville, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 13/905,297

(22) Filed: May 30, 2013

(65) Prior Publication Data

US 2013/0327818 A1 Dec. 12, 2013

Related U.S. Application Data

(60) Provisional application No. 61/657,368, filed on Jun. 8, 2012.

(51) Int. Cl.
*B65D 5/10* (2006.01)
*B65D 5/36* (2006.01)

(52) U.S. Cl.
CPC ..... *B65D 5/3635* (2013.01)
USPC ..... 229/109; 229/117; 229/148

(58) Field of Classification Search
USPC ..... 229/109, 117, 148
See application file for complete search history.

(56) References Cited

U.S. PATENT DOCUMENTS

| | | | |
|---|---|---|---|
| 1,438,698 | A | 12/1922 | Debs |
| 1,623,107 | A | 4/1927 | Goodykoontz |
| 1,843,038 | A | 1/1932 | McIlvain |
| 2,018,707 | A | 10/1935 | Daller |
| 2,171,051 | A | 8/1939 | Stonecypher |
| 2,305,405 | A | 12/1942 | Burrell |
| 2,316,658 | A | 4/1943 | Ames |
| 2,331,753 | A | 10/1943 | Wohlers |
| 2,562,261 | A | 7/1951 | Vern Collins |

(Continued)

FOREIGN PATENT DOCUMENTS

| | | | |
|---|---|---|---|
| CA | 1097283 | A1 | 3/1981 |
| CA | 2656176 | A1 | 1/2008 |

(Continued)

OTHER PUBLICATIONS

International Preliminary Report on Patentability for PCT/US07/15528 mailed Jan. 13, 2009.

(Continued)

*Primary Examiner* — Gary Elkins

(74) *Attorney, Agent, or Firm* — Ungaretti & Harris LLP

(57) ABSTRACT

The present invention provides a carton constructed from a single blank of paperboard material featuring an auto-erecting bottom. The carton includes first through eighth sides panels, a glue flap attached along a fold line to a first side edge of the first side panel, a first bottom flap attached along a fold line to a bottom edge of the second side panel, and a second bottom flap attached along a fold line to a bottom edge of the sixth side panel.

The carton includes a first bottom folding assembly attached to a bottom edge of the third and fourth side panels, a second bottom folding assembly attached to a bottom edge of the seventh and eighth side panels, a third bottom folding assembly attached to the first side panel, and a fourth bottom folding assembly attached to the fifth side panel.

20 Claims, 6 Drawing Sheets

(56) References Cited

U.S. PATENT DOCUMENTS

| | | | | |
|---|---|---|---|---|
| 2,665,804 | A | | 1/1954 | Koester |
| 2,673,023 | A | | 3/1954 | Vander Lugt, Jr. |
| 2,734,626 | A | | 2/1956 | Koester et al. |
| 2,743,010 | A | | 4/1956 | Koester |
| 2,806,592 | A | | 9/1957 | Hatfield |
| 2,839,198 | A | | 6/1958 | Lefevre |
| 2,873,024 | A | | 2/1959 | Koester |
| 2,967,009 | A | | 1/1961 | Lidgard |
| 2,973,119 | A | | 2/1961 | Parker |
| 2,981,407 | A | | 4/1961 | Gaulke et al. |
| 2,998,181 | A | | 8/1961 | Chasolen |
| 3,039,670 | A | | 6/1962 | Hardon |
| 3,089,622 | A | | 5/1963 | Westlake, Jr. |
| 3,114,493 | A | | 12/1963 | Dunkin |
| 3,159,275 | A | | 12/1964 | Van Antwerpen et al. |
| 3,173,579 | A | | 3/1965 | Curie et al. |
| 3,333,392 | A | | 8/1967 | Calvert |
| 3,339,721 | A | | 9/1967 | Goldstein |
| 3,344,971 | A | | 10/1967 | Walker |
| 3,375,967 | A | | 4/1968 | Robinson |
| 3,385,462 | A | | 5/1968 | Deldime et al. |
| 3,389,785 | A | | 6/1968 | Lidgard |
| 3,403,778 | A | | 10/1968 | Voytko et al. |
| 3,411,264 | A | | 11/1968 | Farquhar |
| 3,469,762 | A | | 9/1969 | La Torre |
| 3,476,303 | A | | 11/1969 | Smith |
| 3,493,128 | A | | 2/1970 | Silvert |
| 3,519,244 | A | | 7/1970 | Lidgard |
| 3,616,986 | A | | 11/1971 | Wolfe |
| 3,643,856 | A | | 2/1972 | Jones |
| 3,744,702 | A | | 7/1973 | Ellison |
| RE27,872 | E | | 1/1974 | Esty |
| 3,884,356 | A | | 5/1975 | Lidgard |
| 3,900,976 | A | | 8/1975 | Kitts, Jr. |
| 3,908,864 | A | | 9/1975 | Capper |
| 3,913,822 | A | | 10/1975 | Heaps, Jr. |
| 3,938,660 | A | | 2/1976 | Moehring |
| 3,964,608 | A | | 6/1976 | Rowley |
| 3,985,231 | A | | 10/1976 | Farhat et al. |
| 3,995,738 | A | | 12/1976 | Rowley et al. |
| 4,010,849 | A | | 3/1977 | Pater et al. |
| 4,014,435 | A | | 3/1977 | Rowley et al. |
| 4,086,263 | A | | 4/1978 | Rowley |
| 4,098,401 | A | | 7/1978 | Brown et al. |
| 4,119,263 | A | | 10/1978 | Cuthbertson et al. |
| 4,165,024 | A | | 8/1979 | Oswalt et al. |
| 4,174,051 | A | | 11/1979 | Edwards et al. |
| 4,182,450 | A | | 1/1980 | Kryger |
| 4,225,043 | A | | 9/1980 | Lastik |
| 4,232,803 | A | | 11/1980 | Muller et al. |
| 4,268,555 | A | | 5/1981 | Kantz |
| 4,273,485 | A | | 6/1981 | Fischer et al. |
| 4,317,536 | A | | 3/1982 | Dickerson |
| 4,335,830 | A | | 6/1982 | Garganese |
| 4,380,314 | A | | 4/1983 | Langston et al. |
| 4,467,922 | A | | 8/1984 | Rowley |
| 4,477,015 | A | | 10/1984 | Lozaun |
| 4,489,835 | A | | 12/1984 | Tombal et al. |
| 4,585,143 | A | | 4/1986 | Fremow et al. |
| 4,586,627 | A | | 5/1986 | Grigsby |
| 4,601,407 | A | | 7/1986 | Gillard |
| 4,623,072 | A | | 11/1986 | Lorenz |
| 4,635,815 | A | | 1/1987 | Grigsby |
| 4,688,716 | A | | 8/1987 | Winterling |
| 4,693,413 | A | | 9/1987 | McFarland et al. |
| 4,697,731 | A | | 10/1987 | Snyder |
| 4,786,192 | A | | 11/1988 | Graves et al. |
| 4,793,519 | A | | 12/1988 | Voorhies, Jr. |
| 4,848,542 | A | | 7/1989 | Burnette et al. |
| 4,850,506 | A | | 7/1989 | Heaps et al. |
| 4,863,021 | A | | 9/1989 | Crittenden |
| 4,871,067 | A | | 10/1989 | Valenti |
| 4,898,301 | A | | 2/1990 | Schick |
| 4,934,654 | A | | 6/1990 | Linnemann |
| 4,945,711 | A | | 8/1990 | Crittenden |
| 5,042,684 | A | | 8/1991 | West et al. |
| 5,050,775 | A | | 9/1991 | Marquardt |
| 5,085,367 | A | | 2/1992 | Carstens |
| 5,087,005 | A | | 2/1992 | Holoff et al. |
| 5,105,946 | A | | 4/1992 | McDowell |
| 5,111,937 | A | | 5/1992 | Schutz |
| 5,139,196 | A | * | 8/1992 | Fry et al. ..... 229/157 |
| 5,145,073 | A | | 9/1992 | Kitagawa et al. |
| 5,174,448 | A | | 12/1992 | Flaig |
| 5,201,462 | A | | 4/1993 | Sada et al. |
| 5,265,753 | A | | 11/1993 | Moorman |
| 5,269,422 | A | | 12/1993 | Chevrette |
| 5,285,957 | A | | 2/1994 | Halswell |
| 5,314,088 | A | | 5/1994 | Heuberger et al. |
| 5,320,225 | A | | 6/1994 | Kirkpatrick |
| 5,351,849 | A | | 10/1994 | Jagenburg et al. |
| 5,353,982 | A | | 10/1994 | Perkins et al. |
| 5,372,255 | A | | 12/1994 | Skorski |
| 5,437,384 | A | | 8/1995 | Farrell |
| 5,535,941 | A | | 7/1996 | Garza |
| 5,566,851 | A | | 10/1996 | Sasaki et al. |
| 5,575,389 | A | | 11/1996 | Alspach |
| 5,605,229 | A | | 2/1997 | Sowa |
| 5,628,450 | A | * | 5/1997 | Cromwell et al. ..... 229/109 |
| 5,657,872 | A | | 8/1997 | Leftwich et al. |
| 5,697,549 | A | | 12/1997 | Yocum |
| 5,722,584 | A | | 3/1998 | Fujiwara |
| 5,749,489 | A | | 5/1998 | Benner et al. |
| 5,799,861 | A | | 9/1998 | Bonner et al. |
| 5,820,116 | A | | 10/1998 | Haese |
| 5,860,555 | A | | 1/1999 | Mayled |
| 5,897,012 | A | | 4/1999 | Sortwell |
| 5,906,568 | A | | 5/1999 | Sato et al. |
| 5,915,617 | A | * | 6/1999 | Gasper ..... 229/117 |
| 5,938,108 | A | | 8/1999 | Williams et al. |
| 5,944,252 | A | | 8/1999 | Connelly et al. |
| 5,950,914 | A | | 9/1999 | Dunton et al. |
| 5,950,915 | A | | 9/1999 | Moen |
| 5,975,413 | A | | 11/1999 | Moen |
| 6,000,549 | A | | 12/1999 | Perkins |
| 6,000,604 | A | | 12/1999 | Lapoint, III |
| 6,029,884 | A | | 2/2000 | Roeland |
| 6,112,928 | A | | 9/2000 | Black et al. |
| 6,138,903 | A | | 10/2000 | Baker |
| 6,186,932 | B1 | | 2/2001 | Vallot |
| 6,267,255 | B1 | | 7/2001 | Brush |
| 6,290,124 | B2 | | 9/2001 | Andrews, Sr. et al. |
| 6,371,363 | B1 | * | 4/2002 | Franklin et al. ..... 229/117 |
| 6,454,113 | B1 | | 9/2002 | Schutz |
| 6,478,182 | B2 | | 11/2002 | Karpisek |
| 6,510,982 | B2 | | 1/2003 | White et al. |
| 6,527,120 | B2 | | 3/2003 | Okamoto |
| 6,659,132 | B2 | | 12/2003 | Smith et al. |
| 6,685,084 | B2 | | 2/2004 | Timbrook et al. |
| 6,761,307 | B2 | | 7/2004 | Matsuoka |
| 6,834,792 | B1 | | 12/2004 | Perkins |
| 6,902,061 | B1 | | 6/2005 | Elstone |
| 7,441,658 | B2 | | 10/2008 | McDowell |
| 7,552,838 | B2 | | 6/2009 | McDowell |
| 7,607,564 | B2 | | 10/2009 | Churvis et al. |
| 7,886,778 | B2 | | 2/2011 | McDowell |
| 7,992,765 | B2 | | 8/2011 | Brand |
| 8,141,708 | B2 | | 3/2012 | McDowell |
| 8,474,618 | B2 | | 7/2013 | McDowell |
| 2002/0148885 | A1 | | 10/2002 | Prince |
| 2003/0059130 | A1 | | 3/2003 | Yoneyama et al. |
| 2004/0016669 | A1 | | 1/2004 | Allison |
| 2004/0112012 | A1 | | 6/2004 | Salva Transfiguracion et al. |
| 2004/0187445 | A1 | | 9/2004 | Hildebrandt, Jr. |
| 2004/0188504 | A1 | | 9/2004 | Pierce |
| 2005/0025398 | A1 | | 2/2005 | Edwards et al. |
| 2005/0082355 | A1 | | 4/2005 | Beutler |
| 2005/0196080 | A1 | | 9/2005 | Stone et al. |
| 2006/0016709 | A1 | | 1/2006 | Chen et al. |
| 2006/0120631 | A1 | | 6/2006 | Tang |
| 2006/0144910 | A1 | | 7/2006 | Wachter |
| 2006/0169757 | A1 | | 8/2006 | McDowell |
| 2007/0051783 | A1 | * | 3/2007 | Wisecarver ..... 229/109 |

(56) References Cited

U.S. PATENT DOCUMENTS

| | | | | |
|---|---|---|---|---|
| 2007/0063002 | A1* | 3/2007 | Zacher et al. | 229/109 |
| 2008/0150244 | A1 | 6/2008 | Carlei | |
| 2012/0074037 | A1 | 3/2012 | Orischak et al. | |

FOREIGN PATENT DOCUMENTS

| | | | | |
|---|---|---|---|---|
| CA | 2629572 | A1 | 10/2008 | |
| EP | 0047616 | A1 | 3/1982 | |
| GB | 1332546 | A | 10/1973 | |
| GB | 2243596 | A * | 11/1991 | 229/109 |
| MX | 302793 | | 8/2012 | |
| MX | 309369 | | 5/2013 | |
| WO | 2008008272 | A2 | 3/2008 | |

OTHER PUBLICATIONS

International Search Report for PCT/Us07/15528 mailed Jul. 11, 2008.

Written Opinion of International Searching Authority for PCT/US07/15528 mailed Jul. 11, 2008.

* cited by examiner

FOLDING CARTON WITH AUTO-ERECTING BOTTOM

CROSS-REFERENCE TO RELATED APPLICATIONS

This application claims the benefit of U.S. Provisional Application Ser. No. 61/657,368, filed Jun. 8, 2012, the contents of which are incorporated herein by reference.

FEDERALLY SPONSORED RESEARCH OR DEVELOPMENT

N/A

TECHNICAL FIELD

The present invention generally relates to a carton formed from a single blank of a paperboard material. The carton holds a bag container within for dispensing wine or other liquids therefrom.

BACKGROUND OF THE INVENTION

"Bag in a box" dispensers are well-known in the art. These dispensers are used with a variety of liquid products, including juices, wine, milk, and the like. Some boxes associated with the "bag in a box" dispensers are difficult to construct, and are made using multiple pieces of material. Others are plain, simple and lack aesthetic appeal.

SUMMARY OF THE INVENTION

The present invention provides an aesthetically pleasing, unique carton or container that is easily constructed from a single blank of paperboard material, such as cardboard. The carton of the present invention features an auto-erecting bottom. The carton can be scaled to accommodate varying sizes of bags.

A blank for forming the carton and the carton itself are provided. The blank and carton include a first side panel, a second side panel attached to the first side panel along a fold line, a third side panel attached to the second side panel along a fold line, and a fourth side panel attached to the third side panel along a fold line.

The blank and carton further include a fifth side panel attached to the fourth side panel along a fold line, a sixth side panel attached to the fifth side panel along a fold line, a seventh side panel attached to the sixth side panel along a fold line, and an eighth side panel attached to the seventh side panel along a fold line. The first through eighth side panels generally form an octagon shape.

The blank and carton also include a glue flap attached along a fold line to a first side edge of the first side panel, a first bottom flap attached along a fold line to a bottom edge of the second side panel, and a second bottom flap attached along a fold line to a bottom edge of the sixth side panel.

The blank and carton include a first bottom folding assembly attached along fold lines to a bottom edge of the third and fourth side panels, a second bottom folding assembly attached along fold lines to a bottom edge of the seventh and eighth side panels, a third bottom folding assembly attached along a fold line to the first side panel, and a fourth bottom folding assembly attached along a fold line to the fifth side panel. The first through fourth bottom folding assemblies form an auto-erecting bottom of the carton.

The carton of the present invention can be made with planet-friendly packaging materials made with up to 100% recycled content. The materials used can also be FDA-compliant material for refrigerated/frozen/standard foods. Moreover, the inks employed can be composed of 61% soy and vegetable-based by-products.

BRIEF DESCRIPTION OF THE DRAWINGS

To understand the present invention, it will now be described by way of example, with reference to the accompanying drawings in which.

DETAILED DESCRIPTION

Figure 1:
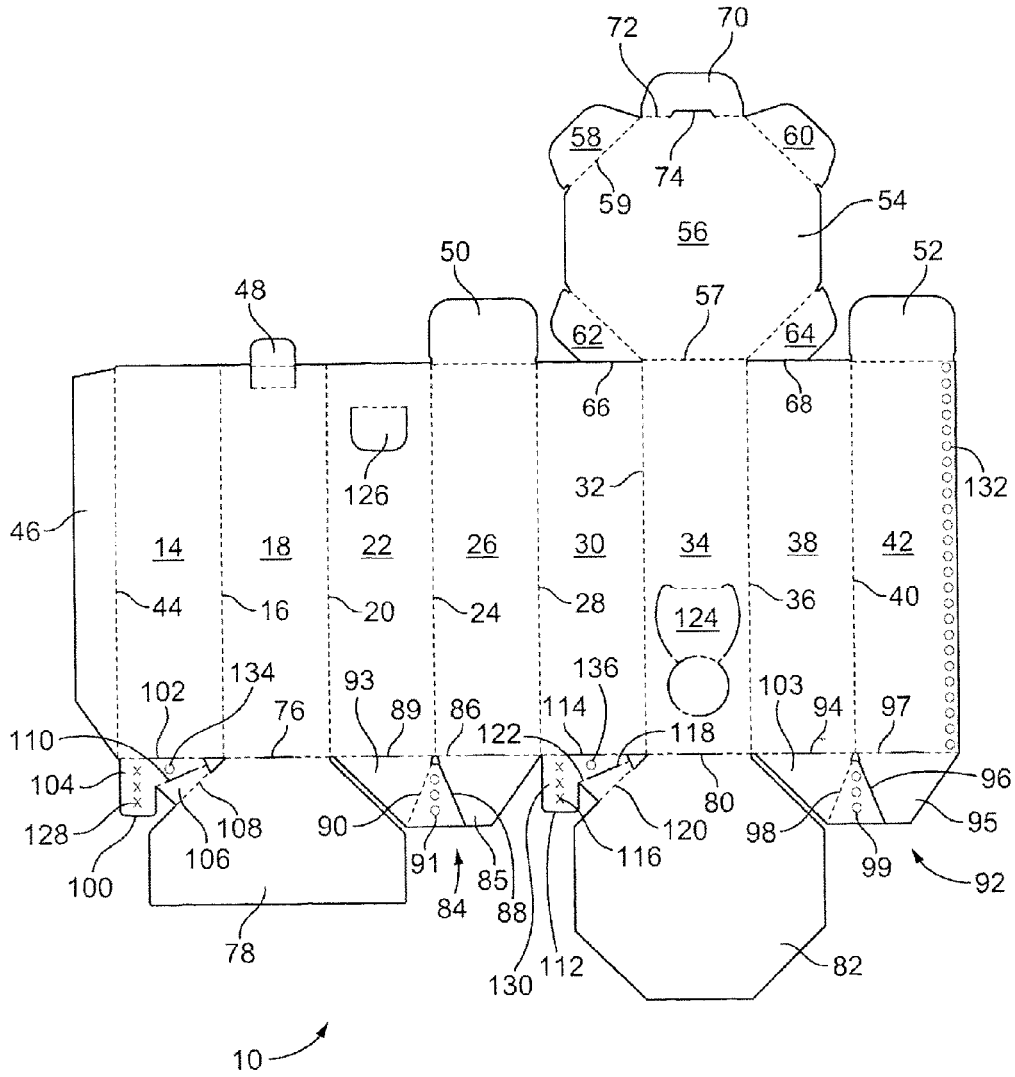
FIG. 1 is a top plan view of a blank for forming a carton made in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 6:
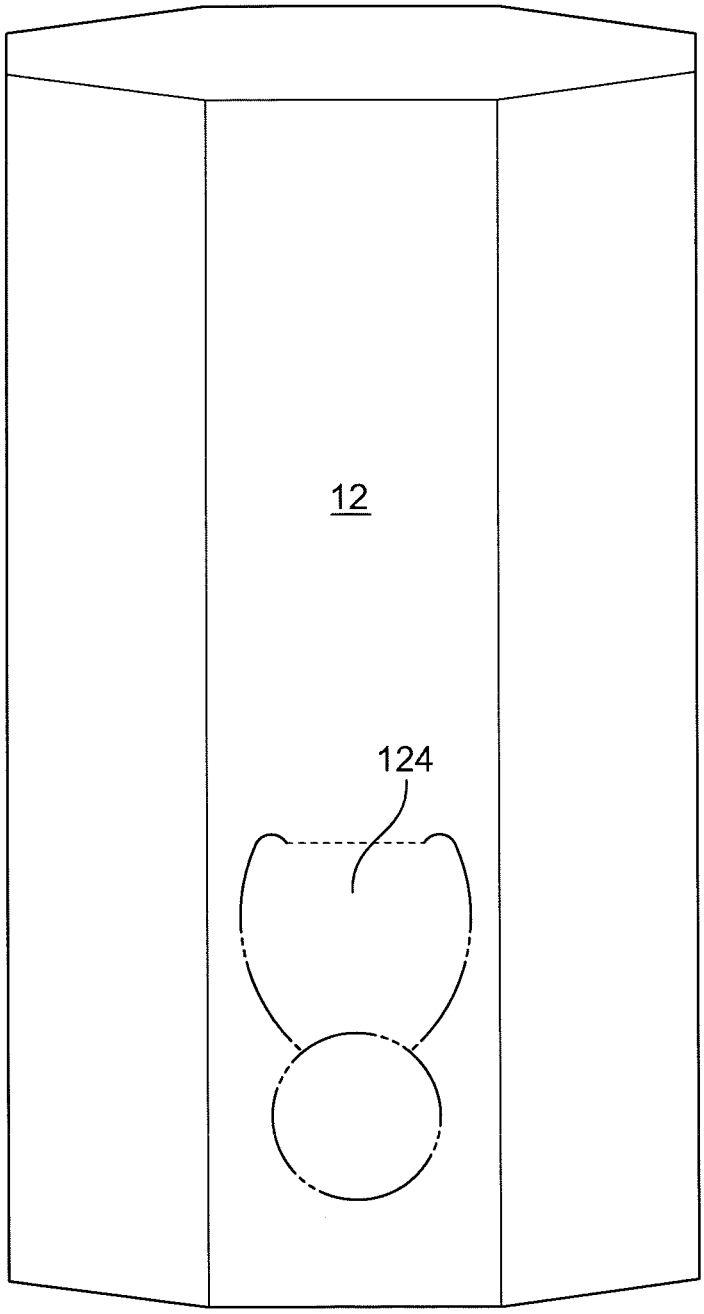

Referring to FIGS. 1 and 6, a single blank 10 for forming a carton 12 is provided in accord with an embodiment of the present invention. The blank 10 includes a first side panel 14. Attached to the first side panel 14 along a first fold line 16 is a second side panel 18. Attached to the second side panel 18 along a second fold line 20 is a third side panel 22. Attached to the third side panel 22 along a third fold line 24 is a fourth side panel 26. Attached to the fourth side panel 26 along a fourth fold line 28 is a fifth side panel 30. Attached to the fifth side panel 30 along a fifth fold line 32 is a sixth side panel 34. Attached to the sixth side panel 34 along a sixth fold line 36 is a seventh side panel 38. Attached to the seventh side panel 38 along a seventh fold line 40 is an eighth side panel 42. Attached along a fold line 44 to a first side edge of the first side panel 14 is a glue flap 46.

Attached along a top edge of the second side panel 18 is a locking flap 48. Attached along a top edge of each of the fourth and eighth side panels 26 and 42 are two top flaps 50,52, respectively. Attached along a top edge of the fifth, sixth and seventh side panels 30,34,38 is a top cover panel 54. The top cover panel 54 includes a center panel 56. The center panel 56 is preferably octagonal. The center panel 56 is also attached to the top edge of the sixth side panel 34 along an eighth fold line 57. Attached along top fold lines 59 at alternating sides of the center panel 56 are first, second, third and fourth top cover flaps 58,60,62,64. The third and fourth top cover flaps 62,64 are attached along cut lines 66,68 to the top edges of the fifth and seventh side panels 30,38, respectively. Between the first and second top cover flaps 58,60, a top cover locking flap 70 is attached to the center panel 56 along an ninth fold line 72. The locking flap 70 includes a cutout 74 to accept the locking flap 48 to secure the top cover panel 54 in place.

Attached along a tenth fold line 76 to a bottom edge of the second side panel 18 is a first bottom flap 78. Attached along an eleventh fold line 80 to a bottom edge of the sixth side panel 34 is a second bottom flap 82.

A first bottom folding assembly 84 includes a first bottom tab 85 attached along a twelfth fold line 86 to a bottom edge of the fourth side panel 26, and a securement panel 93 attached along a thirteenth fold line 89 to a bottom edge of the third side panel 22. The first bottom folding assembly 84 includes a fourteenth fold line 90 and a cut line 88. The first bottom folding assembly 84 also includes a glue panel 91 attached to the securement panel 93 along the fourteenth fold line 90.

A second bottom folding assembly 92 includes a second bottom tab 95 attached along a fifteenth fold line 97 to a bottom edge of the eighth side panel 42, and a securement panel 103 attached along a sixteenth fold line 94 to a bottom edge of the seventh side panel 38. The second bottom assembly 92 includes a seventeenth fold line 98 and a cut line 96. The second bottom assembly 92 also includes a glue panel 99 attached to the securement panel 103 along the seventeenth fold line 98.

A third bottom folding assembly 100 is attached along an eighteenth fold line 102 to the first side panel 14. The third bottom folding assembly 100 also includes a glue panel 104. A first connecting panel 106 is connected along a nineteenth fold line 108 to the first bottom flap 78 at one end and to the glue panel 104 along a twentieth fold line 110 at an other end.

A fourth bottom folding assembly 112 is attached along a twenty-first fold line 114 to the fifth side panel 30. The fourth bottom folding assembly 112 also includes a glue panel 116. A second connecting panel 118 is connected along a twenty-second fold line 120 to the second bottom flap 82 at one end and to the glue panel 116 along a twenty-third fold line 122 at an other end.

Near the bottom edge of the sixth side panel 34 is a cutout 124 to accept a spigot from a bag (not shown) within the carton 12. Near the top edge of the third side panel 22 is a cutout 126 for use as a finger-hole to carry the carton.

Figure 2:
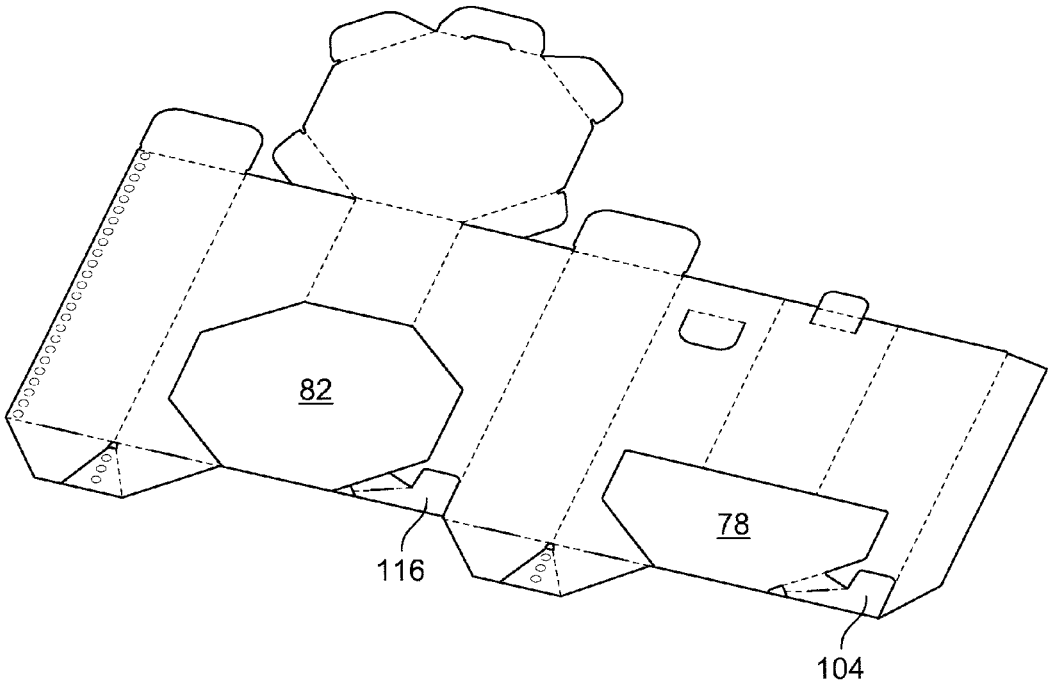
FIG. 2 is a perspective view showing the blank of FIG. 1 being folded into a carton in accordance with the present invention.

To assemble the carton 12 from the blank 10, as shown in FIGS. 2-6, the first and second bottom flaps 78,82 are folded upwards along the tenth and eleventh fold lines 76,80, respectively. (FIG. 2). Third and fourth bottom folding assemblies 100 and 112 are likewise folded upward along the eighteenth and twenty-first fold lines 102,114 as they are attached to the first and second bottom flaps 78,82. The glue panels 104,116 are hot glued along glue lines 128 and 130 to the interior surfaces of the first and fifth side panels 14,30, respectively.

Figure 3:
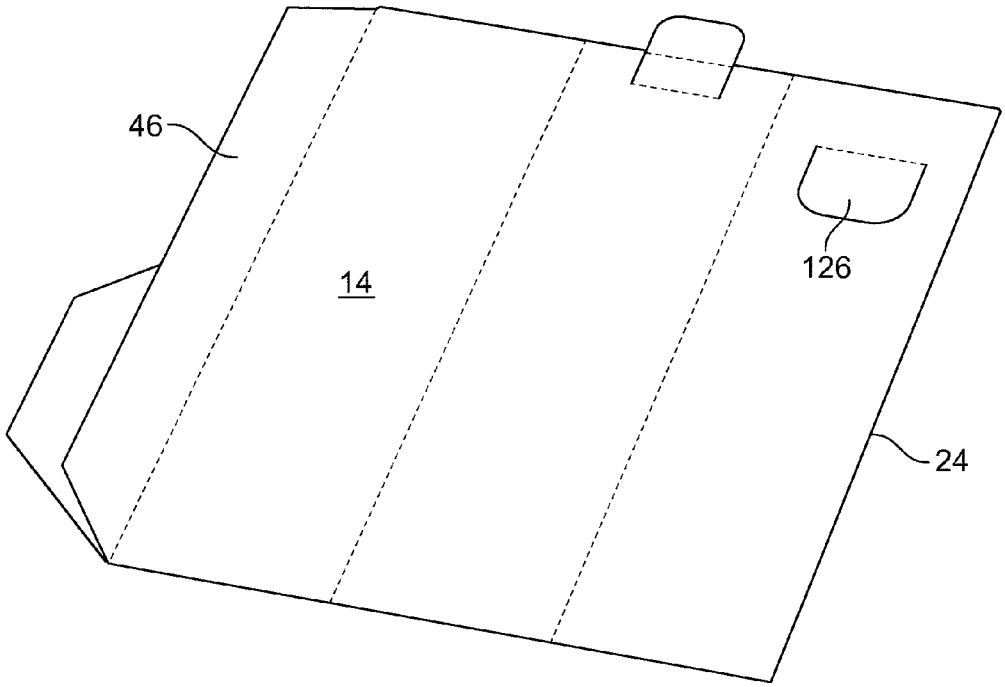
FIG. 3 is a perspective view showing the blank of FIGS. 1 and 2 being further folded into a carton in accordance with the present invention.
Figure 4:
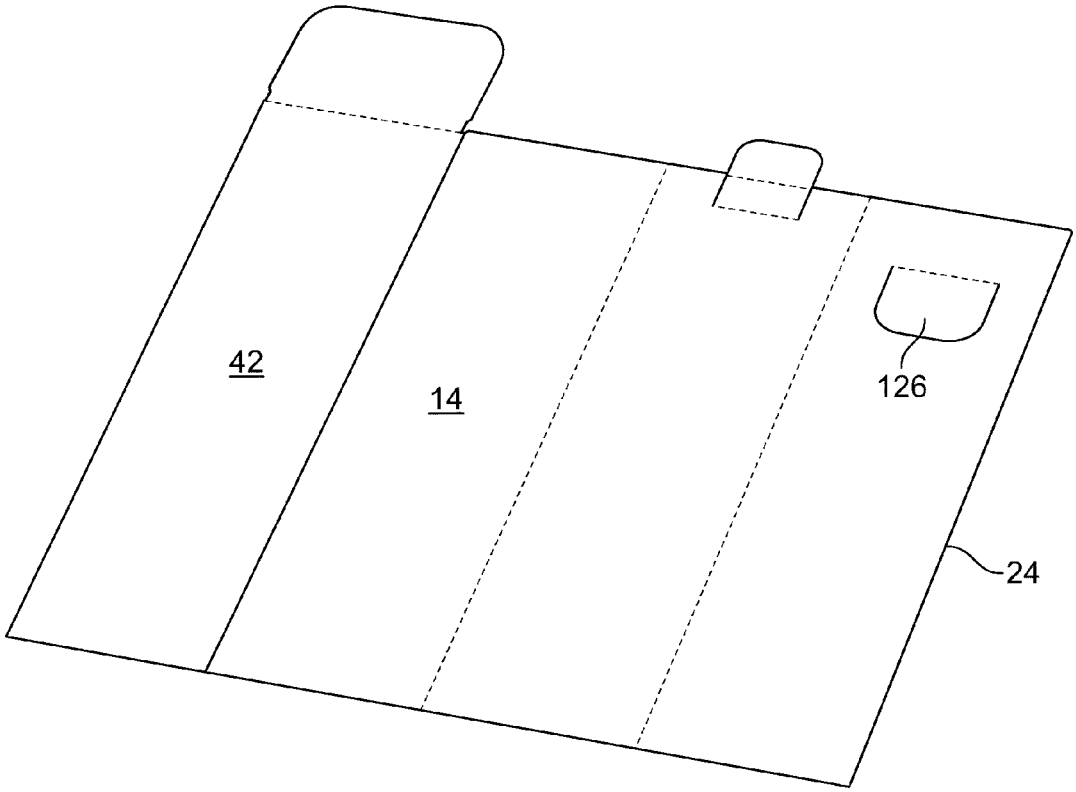
FIG. 4 is a perspective view showing the blank of FIGS. 1-3 being still further folded into a carton in accordance with the present invention.

Securement panels 93,103 are folded upward along thirteenth and sixteenth fold lines 89,94, respectively. Glue panels 91,99 are back-folded on fourteenth and seventeenth fold lines 90, 98, respectively. Cold glue is applied to glue panel 91. The blank 10 is then folded inwards along the third fold line 24 connecting the third and fourth side panels 22,26 such that the first, second, and third side panels 14,18,22 overlap the fourth, fifth, and sixth side panels 26,30,34. (FIG. 3). As the blank 10 is folded along the third fold line 24, glue panel 91 adheres to first bottom tab 85. Cold glue is also applied to glue panel 99 and glue flap 46 as indicated by reference numeral 132. The blank 10 is folded along seventh fold line 40 to adhere glue panel 99 to second bottom tab 95 and eighth panel 42 to glue flap 46. In an embodiment of the present invention, the blank 10 is shipped to a customer in the state shown in FIG. 4.

Figure 5:
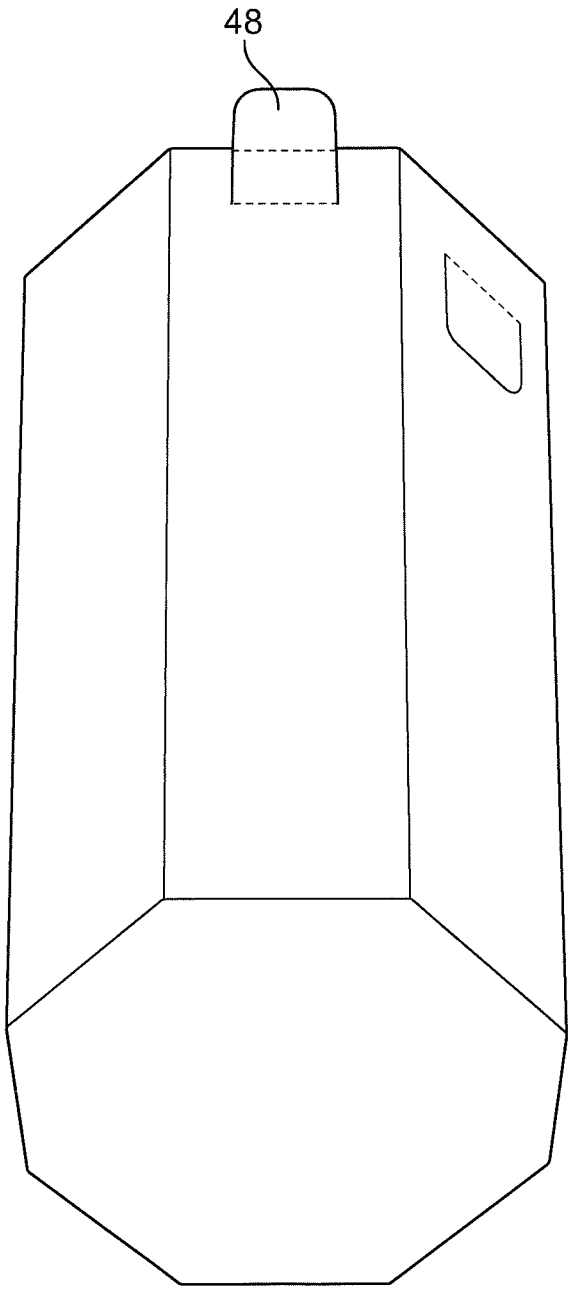
FIG. 5 is a perspective bottom view showing the carton in accordance with the present invention; and, FIG. 6 is a perspective view of the carton in accordance with the present invention.

When the customer prepares the blank 10 to form a carton 12, the customer expands the folded blank 10 along the fold lines connecting the side panels until the carton 12 takes shape without the need for additional gluing or construction. The first and second bottom folding assemblies 84,92 are folded downward along the twelfth, thirteenth, fifteenth, and sixteenth fold lines 86,89,97,94. (FIG. 5). The first bottom flap 78 folds downwards along tenth fold line 76. The first connecting panel 106 is back-folded along the nineteenth and twentieth fold lines 108,110. The second bottom flap 82 folds downward along eleventh fold line 80 over the top of the first bottom flap 78. The second connecting panel 118 is back-folded along the twenty-second and twenty-third fold lines 120,122, thus forming the auto-erecting bottom of the carton 12.

To close the top of the carton 12, first through fourth top cover flaps 58,60,62,64 are folded downward along top fold lines 59, top flaps 50,52 are folded inward, and the top cover panel 54 is folded downward along eighth fold line 57. Top cover locking flap 70 is folded downward along ninth fold line 72. Locking tab 48 is inserted into cutout 74.

While the specific embodiments have been illustrated and described, numerous modifications come to mind without significantly departing from the spirit of the invention, and the scope of protection is only limited by the scope of the accompanying Claims.

What is claimed is:

1. A blank for forming a carton comprising:

a first side panel;

a second side panel attached to the first side panel along a fold line;

a third side panel attached to the second side panel along a fold line;

a fourth side panel attached to the third side panel along a fold line;

a fifth side panel attached to the fourth side panel along a fold line;

a sixth side panel attached to the fifth side panel along a fold line;

a seventh side panel attached to the sixth side panel along a fold line;

an eighth side panel attached to the seventh side panel along a fold line;

a glue flap attached along a fold line to a first side edge of the first side panel;

a first bottom flap attached along a fold line to a bottom edge of the second side panel;

a second bottom flap attached along a fold line to a bottom edge of the sixth side panel;

a first bottom folding assembly attached along fold lines to a bottom edge of the third and fourth side panels;

a second bottom folding assembly attached along fold lines to a bottom edge of the seventh and eighth side panels;

a third bottom folding assembly attached along a fold line to the first side panel;

a fourth bottom folding assembly attached along a fold line to the fifth side panel;

a locking flap attached along a top edge of the second side panel;

a pair of top flaps attached along a top edge of each of the fourth and eighth side panels respectively;

a top cover panel attached along a top edge of the fifth, sixth and seventh side panel, the top cover panel including an octagonal center panel attached to the top edge of the sixth side panel along a fold line;

first, second, third and fourth top cover flaps attached along fold lines at alternating sides of the center panel, the third and fourth top cover flaps releasable attached along cut lines to the top edges of the fifth and seventh side panels respectively; and a top cover locking flap attached to the center panel along a fold line between the first and second top cover flaps, the top cover locking flap includes a cutout to accept the locking flap.

2. The blank of claim 1 wherein the first bottom folding assembly includes a bottom tab, a securement panel, and a glue panel.

3. The blank of claim 1 wherein the second bottom assembly includes a bottom tab, a securement panel, and a glue panel.

4. The blank of claim 1 wherein the third bottom folding assembly includes a glue panel and a first connecting panel connected along a fold line to the first bottom flap at one end and to the glue panel along a fold line at an other end.

5. The blank of claim 1 wherein the fourth bottom folding assembly includes a glue panel and a first connecting panel connected along a fold line to the second bottom flap at one end and to the glue panel along a fold line at an other end.

6. The blank of claim 1 further comprising a spigot cutout in at least one of the side panels.

7. The blank of claim 1 further comprising a finger hole in at least one of the side panels.

8. The blank of claim 1 wherein the first, second, third, and fourth bottom folding assemblies form an auto-erecting bottom of the carton.

9. A carton made from a single blank of material, the carton comprising:

a first side panel;

a second side panel attached to the first side panel along a fold line;

a third side panel attached to the second side panel along a fold line;

a fourth side panel attached to the third side panel along a fold line;

a fifth side panel attached to the fourth side panel along a fold line;

a sixth side panel attached to the fifth side panel along a fold line;

a seventh side panel attached to the sixth side panel along a fold line;

an eighth side panel attached to the seventh side panel along a fold line;

a glue flap attached along a fold line to a first side edge of the first side panel;

a first bottom flap attached along fold lines to a bottom edge of the second side panel;

a second bottom flap attached along fold lines to a bottom edge of the sixth side panel;

a first bottom folding assembly attached along a fold line to a bottom edge of the third and fourth side panels;

a second bottom folding assembly attached along a fold line to a bottom edge of the seventh and eighth side panels;

a third bottom folding assembly attached along a fold line to the first side panel;

a fourth bottom folding assembly attached along a fold line to the fifth side panel;

a locking flap attached along a top edge of the second side panel;

a pair of top flaps attached along a top edge of each of the fourth and eighth side panels respectively;

a top cover panel attached along a top edge of the fifth, sixth and seventh side panel, the top cover panel including an octagonal center panel attached to the top edge of the sixth side panel along a fold line;

first, second, third and fourth top cover flaps attached along fold lines at alternating sides of the center panel, the third and fourth top cover flaps releasable attached along cut lines to the top edges of the fifth and seventh side panels respectively; and a top cover locking flap attached to the center panel along a fold line between the first and second top cover flaps, the top cover locking flap includes a cutout to accept the locking flap.

10. The carton of claim 9 wherein the first bottom folding assembly includes a bottom tab, a securement panel, and a glue panel.

11. The carton of claim 9 wherein the second bottom assembly includes a bottom tab, a securement panel, and a glue panel.

12. The carton of claim 9 wherein the third bottom folding assembly includes a glue panel and a first connecting panel connected along a fold line to the first bottom flap at one end and to the glue panel along a fold line at an other end.

13. The carton of claim 9 wherein the fourth bottom folding assembly includes a glue panel and a first connecting panel connected along a fold line to the second bottom flap at one end and to the glue panel along a fold line at an other end.

14. The carton of claim 9 further comprising a spigot cutout in at least one of the side panels.

15. The blank of claim 9 wherein the first, second, third, and fourth bottom folding assemblies form an auto-erecting bottom of the carton.

16. The carton of claim 9 further comprising a finger hole in at least one of the side panels.

17. A blank for forming a carton comprising:

a first side panel;

a second side panel attached to the first side panel along a fold line;

a third side panel attached to the second side panel along a fold line;

a fourth side panel attached to the third side panel along a fold line;

a fifth side panel attached to the fourth side panel along a fold line;

a sixth side panel attached to the fifth side panel along a fold line;

a seventh side panel attached to the sixth side panel along a fold line;

an eighth side panel attached to the seventh side panel along a fold line;

a glue flap attached along a fold line to a first side edge of the first side panel;

a first bottom flap attached along a fold line to a bottom edge of the second side panel;

a second bottom flap attached along a fold line to a bottom edge of the sixth side panel;

a first bottom folding assembly attached along fold lines to a bottom edge of the third and fourth side panels;

a second bottom folding assembly attached along fold lines to a bottom edge of the seventh and eighth side panels;

a third bottom folding assembly attached along a fold line to the first side panel, wherein the third bottom folding assembly includes a glue panel and a first connecting panel connected along a fold line to the first bottom flap at one end and to the glue panel along a fold line at an other end; and a fourth bottom folding assembly attached along a fold line to the fifth side panel.

18. A blank for forming a carton comprising:

a first side panel;

a second side panel attached to the first side panel along a fold line;

a third side panel attached to the second side panel along a fold line;

a fourth side panel attached to the third side panel along a fold line;

a fifth side panel attached to the fourth side panel along a fold line;

a sixth side panel attached to the fifth side panel along a fold line;

a seventh side panel attached to the sixth side panel along a fold line;

an eighth side panel attached to the seventh side panel along a fold line;

a glue flap attached along a fold line to a first side edge of the first side panel;

a first bottom flap attached along a fold line to a bottom edge of the second side panel;

a second bottom flap attached along a fold line to a bottom edge of the sixth side panel;

a first bottom folding assembly attached along fold lines to a bottom edge of the third and fourth side panels;

a second bottom folding assembly attached along fold lines to a bottom edge of the seventh and eighth side panels;

a third bottom folding assembly attached along a fold line to the first side panel; and a fourth bottom folding assembly attached along a fold line to the fifth side panel, wherein the fourth bottom folding assembly includes a glue panel and a first connecting panel connected along a fold line to the second bottom flap at one end and to the glue panel along a fold line at an other end.

19. A carton made from a single blank of material, the carton comprising:

a first side panel;

a second side panel attached to the first side panel along a fold line;

a third side panel attached to the second side panel along a fold line;

a fourth side panel attached to the third side panel along a fold line;

a fifth side panel attached to the fourth side panel along a fold line;

a sixth side panel attached to the fifth side panel along a fold line;

a seventh side panel attached to the sixth side panel along a fold line;

an eighth side panel attached to the seventh side panel along a fold line;

a glue flap attached along a fold line to a first side edge of the first side panel;

a first bottom flap attached along fold lines to a bottom edge of the second side panel;

a second bottom flap attached along fold lines to a bottom edge of the sixth side panel;

a first bottom folding assembly attached along a fold line to a bottom edge of the third and fourth side panels;

a second bottom folding assembly attached along a fold line to a bottom edge of the seventh and eighth side panels;

a third bottom folding assembly attached along a fold line to the first side panel, wherein the third bottom folding assembly includes a glue panel and a first connecting panel connected along a fold line to the first bottom flap at one end and to the glue panel along a fold line at an other end; and a fourth bottom folding assembly attached along a fold line to the fifth side panel.

20. A carton made from a single blank of material, the carton comprising:

a first side panel;

a second side panel attached to the first side panel along a fold line;

a third side panel attached to the second side panel along a fold line;

a fourth side panel attached to the third side panel along a fold line;

a fifth side panel attached to the fourth side panel along a fold line;

a sixth side panel attached to the fifth side panel along a fold line;

a seventh side panel attached to the sixth side panel along a fold line;

an eighth side panel attached to the seventh side panel along a fold line;

a glue flap attached along a fold line to a first side edge of the first side panel;

a first bottom flap attached along fold lines to a bottom edge of the second side panel;

a second bottom flap attached along fold lines to a bottom edge of the sixth side panel;

a first bottom folding assembly attached along a fold line to a bottom edge of the third and fourth side panels;

a second bottom folding assembly attached along a fold line to a bottom edge of the seventh and eighth side panels;

a third bottom folding assembly attached along a fold line to the first side panel; and a fourth bottom folding assembly attached along a fold line to the fifth side panel, wherein the fourth bottom folding assembly includes a glue panel and a first connecting panel connected along a fold line to the second bottom flap at one end and to the glue panel along a fold line at an other end.

* * * * *